US007036950B1

(12) United States Patent
Freeman et al.

(10) Patent No.: US 7,036,950 B1
(45) Date of Patent: May 2, 2006

(54) ILLUMINATED KEY BLANK

(75) Inventors: Daniel Freeman, Calabasas, CA (US); Ari Freeman, Mill Valley, CA (US)

(73) Assignee: Element Extreme, LLC, Mill Valley, CA (US)

( * ) Notice: Subject to any disclaimer, the term of this patent is extended or adjusted under 35 U.S.C. 154(b) by 80 days.

(21) Appl. No.: 10/722,617

(22) Filed: Nov. 26, 2003

Related U.S. Application Data

(60) Provisional application No. 60/450,914, filed on Mar. 3, 2003.

(51) Int. Cl.
*E05B 17/10* (2006.01)

(52) U.S. Cl. ..... 362/100; 362/116

(58) Field of Classification Search ..... 362/100, 362/116, 157, 173, 253, 109, 234, 208, 200, 362/201, 800, 194; 70/456 R, 456 B, 404, 70/408, 395, 459
See application file for complete search history.

(56) References Cited

U.S. PATENT DOCUMENTS

| | | | | | |
|---|---|---|---|---|---|
| 1,816,642 | A | * | 7/1931 | Fetter | 40/330 |
| 1,837,114 | A | | 12/1931 | Cicousel | |
| 1,966,550 | A | | 7/1934 | Handy | |
| 3,085,149 | A | | 4/1963 | Giwosky | |
| 3,310,668 | A | | 3/1967 | Schwartz | |
| 4,085,315 | A | | 4/1978 | Wolter | |
| 4,276,582 | A | | 6/1981 | Burnett | |
| 4,303,966 | A | | 12/1981 | Wolter | |
| 4,349,975 | A | * | 9/1982 | Chubb | 40/330 |
| 4,392,186 | A | | 7/1983 | Cziment | |
| 4,521,833 | A | | 6/1985 | Wolter | |
| 4,562,712 | A | * | 1/1986 | Wolter | 70/456 R |
| 4,787,016 | A | | 11/1988 | Song | |
| 5,158,356 | A | | 10/1992 | Guthrie | |
| 5,181,927 | A | | 1/1993 | Song | |
| 5,386,351 | A | | 1/1995 | Tabor | |
| 5,515,248 | A | | 5/1996 | Canfield | |
| 5,541,817 | A | | 7/1996 | Hung | |
| 5,730,013 | A | | 3/1998 | Huang | |
| 5,775,148 | A | | 7/1998 | Layton et al. | |
| 6,079,845 | A | | 6/2000 | Kreider | |
| 6,089,060 | A | * | 7/2000 | Steeley | 70/456 R |
| 6,106,131 | A | | 8/2000 | Hao | |
| 6,132,058 | A | * | 10/2000 | Kuo | 362/116 |
| 6,224,228 | B1 | | 5/2001 | Frederick | |
| 6,244,722 | B1 | * | 6/2001 | Seebock | 362/116 |
| 6,609,811 | B1 | * | 8/2003 | Sharrah | 362/116 |
| 6,817,217 | B1 | * | 11/2004 | McGuire et al. | 70/408 |

* cited by examiner

*Primary Examiner*—Stephen Husar
*Assistant Examiner*—Hargobind S. Sawhney
(74) *Attorney, Agent, or Firm*—Levisohn, Berger & Langsam, LLP

(57) ABSTRACT

An illuminated key blank is provided with a blade and a head integral with the blade as a single piece. A cutout is preferably formed in the key blank head so that the head is substantially U-shaped, and a battery is disposed in the cutout between the arms of the U. A light source, preferably a light-emitting diode (LED), is selectively electrically connected to the battery. A casing is sealed around the head of the key and the battery, and the casing retains the light source in place so that the light source shines light substantially in the direction of the blade. The light source shines light which is preferably the same or a contrasting color as the color of the casing so that the key may be identified in the dark.

24 Claims, 6 Drawing Sheets

CROSS SECTION VIEW

ILLUMINATED KEY BLANK

RELATED APPLICATIONS

This claims domestic priority from U.S. provisional patent application No. 60/450,914 filed Mar. 3, 2003 and incorporates by reference all of its teachings herein.

BACKGROUND OF THE INVENTION

1. Field of the Invention

The invention relates to keys, and more specifically to a combination key blank with light source.

2. Description of the Related Art

Keys used to open locks are universally known and come in a multitude of different shapes and sizes. It is common that one needs to open a lock under dim or darkened conditions. As such, it would be advantageous to provide a light source attached to or built into a key so that it may illuminate the darkened lock and facilitate the opening of the lock.

Several have tried this approach in the past with limited or no commercial success. For example, U.S. Pat. No. 4,276,582 to Burnett; U.S. Pat. No. 4,392,186 to Cziment; U.S. Pat. No. 4,521,833 to Wolter; U.S. Pat. No. 5,541,817 to Hung; and U.S. Pat. No. 5,730,013 to Huang all describe complex devices that involve associating a light with a key. In Burnett, Wolter, and Huang, e.g., the head of the key is a separate piece from the shank or blade of the key, and the two components must be assembled in a secure fashion. Failure of such a two-piece device is potentially catastrophic, since the head will separate from the blade while the blade is inserted into the lock, thereby potentially ruining the lock and stranding the user on the wrong side of the lock.

Other prior art devices such as that shown in U.S. Pat. No. 6,224,228 to Frederick describe a retrofit kit that can be added onto an existing key or key blank at the locksmith's store. The drawback to this device and method is that it requires the locksmith to purchase a specialized metal hole punch for punching a hole into the head of the key as desired. Such an expense will likely not be undertaken by a locksmith and is not market-friendly, as it adds significant labor to each key-cutting operation and takes up room in the locksmith's workshop. With such a system, the locksmith is committing to an expensive system from which he would likely not derive substantial sales sufficient to justify the cost of the system.

Finally, many of the prior devices are simply not secure and include a great number of customized components. The greater the number of components, the more expensive the final product. Any simplification in the design which can result in a reduction of the number of parts employed would be a great improvement in this field. Since each unit sold is typically very inexpensive (e.g., in the range of 50 cents to two dollars), the wholesaler earns its revenue based on high volumes of sales; a few pennies' difference per unit would be significant.

SUMMARY OF THE INVENTION

It is an object of the invention to provide an illuminated key blank that is easy and inexpensive to manufacture.

It is another object of the invention to provide an illuminated key blank that has a minimal number of parts.

It is another object of the invention to provide an illuminated key blank that is structurally sound and will not deform or break during use.

It is another object of the invention to provide an illuminated key blank that is weather-resistant.

It is another object of the invention to provide an illuminated key blank that will enable the user to identify specific keys quickly and in the dark from among a plurality of keys.

It is another object of the invention to provide a method for making an illuminated key blank that is cost effective and easy to perform.

The above and other objects are fulfilled by the invention, which is an illuminated key blank. The inventive key blank includes a main body having a blade and a head integral with the blade as a single piece. A cutout is formed in the head, and a battery is disposed in the cutout. A light source, is selectively electrically connectable to the battery via user actuation. A casing is sealed, preferably permanently, around the head and the battery. The casing holds the light source in place so as to shine light substantially in the direction of the blade.

The main body may be made from a conventional premade blank key with the cutout formed via one of cutting or punching. Alternatively and preferably, the main body may be preformed with the cutout. The casing is preferably made from colored plastic. So that the key may be identified in the dark, the light source shines light that is preferably substantially the same color as the casing. Alternatively, it may be a contrasting color for the same effect (e.g., a black casing may be matched up to a yellow light source). The light source is preferably a light-emitting diode (LED) having leads, one of which is selectively connectable to the battery.

In the preferred embodiment, the head is substantially U-shaped and the battery is disposed in the cutout between the arms of the U. The casing substantially conforms to the profile of the head and does not substantially increase the overall profile of the head.

The casing preferably includes an upper housing and a lower housing matingly secured together around the head, e.g., by sonic welding, gluing, or the like. At least one of the upper and lower housings includes a recess shaped to receive the head. In the preferred embodiment of the substantially U-shaped head, the upper and lower housings each having a substantially U-shaped recess to receive the head. Additionally, a first recess is formed in the upper housing within the first substantially U-shaped recess, a hole is formed in the upper housing within the round recess, and a second recess formed in the lower housing within the second substantially U-shaped recess adapted to receive the battery. The two substantially U-shaped recesses matingly correspond when the upper and lower housings are sealed together. An actuator, such as a resilient button, is disposed in the first and second non-U-shaped recesses and is accessible from outside the casing by the user via the hole. When the user activates the actuator, the selectively connectable lead is electrically connected to the battery and the light source is activated.

Each of the upper and lower housings preferably includes a recess shaped to receive and retain the light source. Specifically, a first recess is formed in the upper housing shaped to receive and retain the light source, and a second recess is formed in the lower housing shaped to receive and retain the light source. The first and second recesses matingly correspond when the upper and lower housings are sealed together. The casing also may preferably include a first channel formed in the upper housing adapted to receive one of the leads of the light source, and a second channel formed in the lower housing adapted to receive the other of the leads of the light source.

The invention also includes a set of keys including at least two such key blanks as described above. A first key blank includes a first casing of a first color, and the second key blank includes a second casing of a second color different from the first color. As above, at least one of the first and second light sources shines light that is substantially the same color as (or a contrasting color to) its respective casing. In this way, a person may not only use the keys in the dark, the person can identify which key is which in the dark as well (simply color-coding the casings does the user little good in poor lighting conditions, under which all colors tend to appear grey to the eye).

DETAILED DESCRIPTION OF THE PREFERRED EMBODIMENTS

Description will now be given of the invention with reference to the appended FIGS. 1–7. It should be noted that these drawings are exemplary in nature and in no way serve to limit the scope of the invention, which is defined by the claims appearing hereinbelow.

Figure 1:
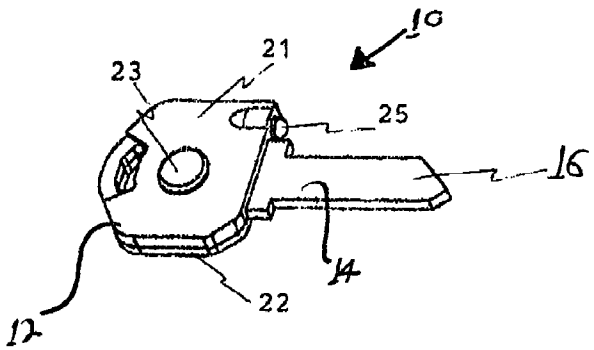
FIG. 1 is a perspective view of a key blank in accordance with the invention.
Figure 2:
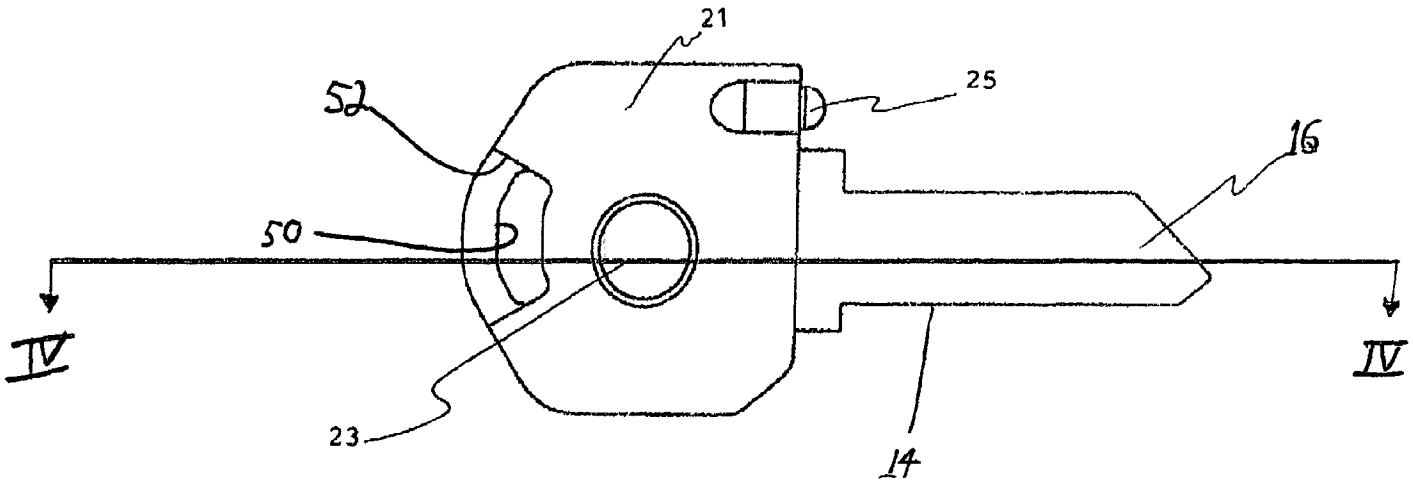
FIG. 2 is a top elevational view of the key blank of FIG. 1.
Figure 3:
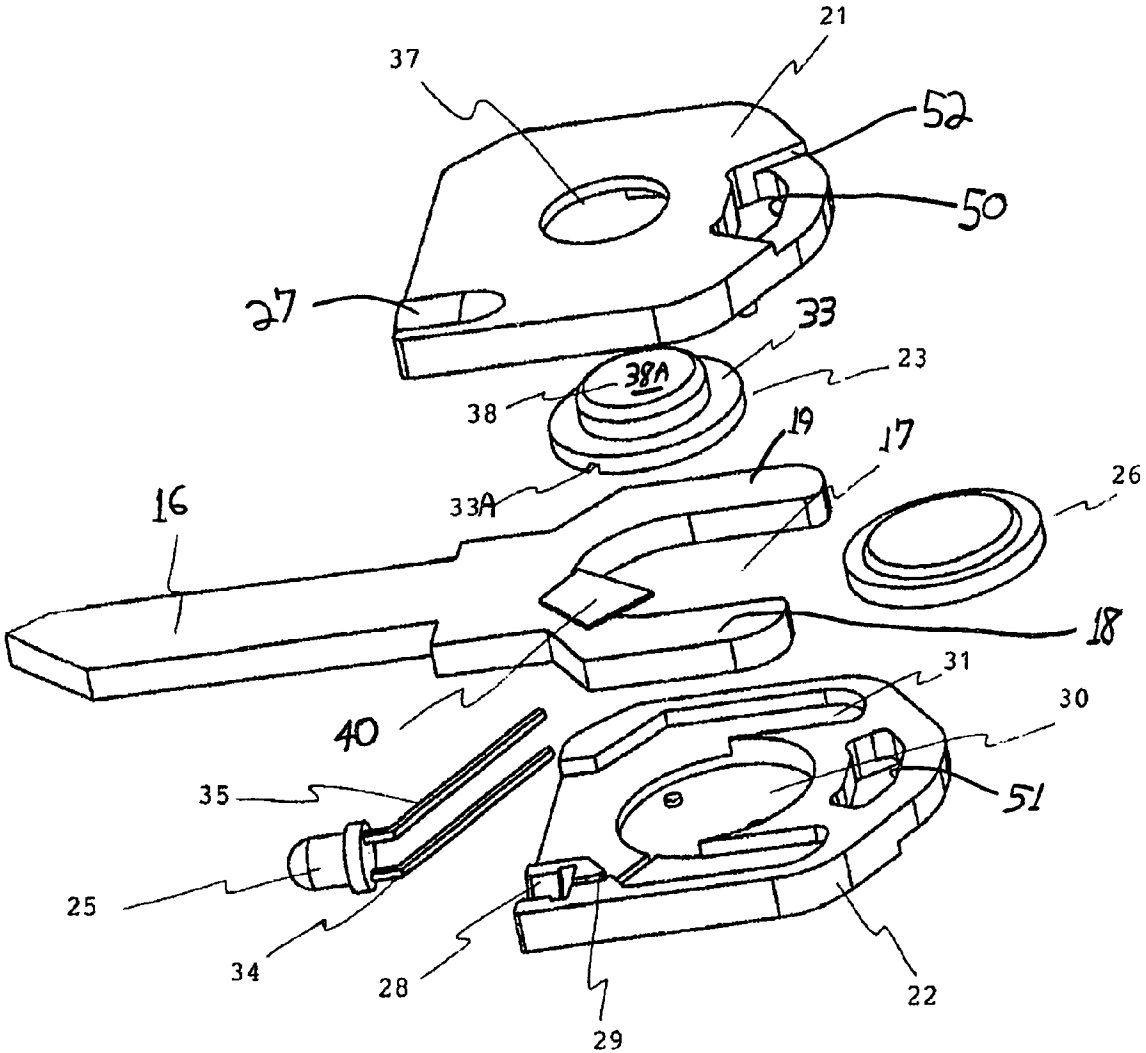
FIG. 3 is an exploded perspective view of the key blank of FIG. 1.

As shown in FIGS. 1–4, the main sections of the inventive key blank 10 are casing 12 and blank body 14. Blank body 14 includes a blade portion 16 and a head portion 18. Blade 16 and head 18 function as in conventional keys, i.e., blade 16 is to be cut to open a lock when inserted therein and head 18 forms a handle for the user to turn the key in the lock and to retain the key on a key ring or chain. Blade 16 and head 18 are integral with one another; that is, there is no connective or securing means that attaches the head to the blade. They are formed from the same piece of material, preferably metal. As best shown in FIG. 3, head 18 is preferably U-shaped and includes two arms 19 surrounding a cutout 17. Blank body 14 may be prefabricated with cutout 17, or cutout 17 may be literally cut or stamped out of the head after manufacture of blank body 14. The use of the term "cutout" here only refers to the absence of material between arms 19. Battery 26 is preferably disposed within cutout 17. Alternatively, no cutout is provided, and the battery is retained against the head of the blank body inside casing 12.

Figure 7:
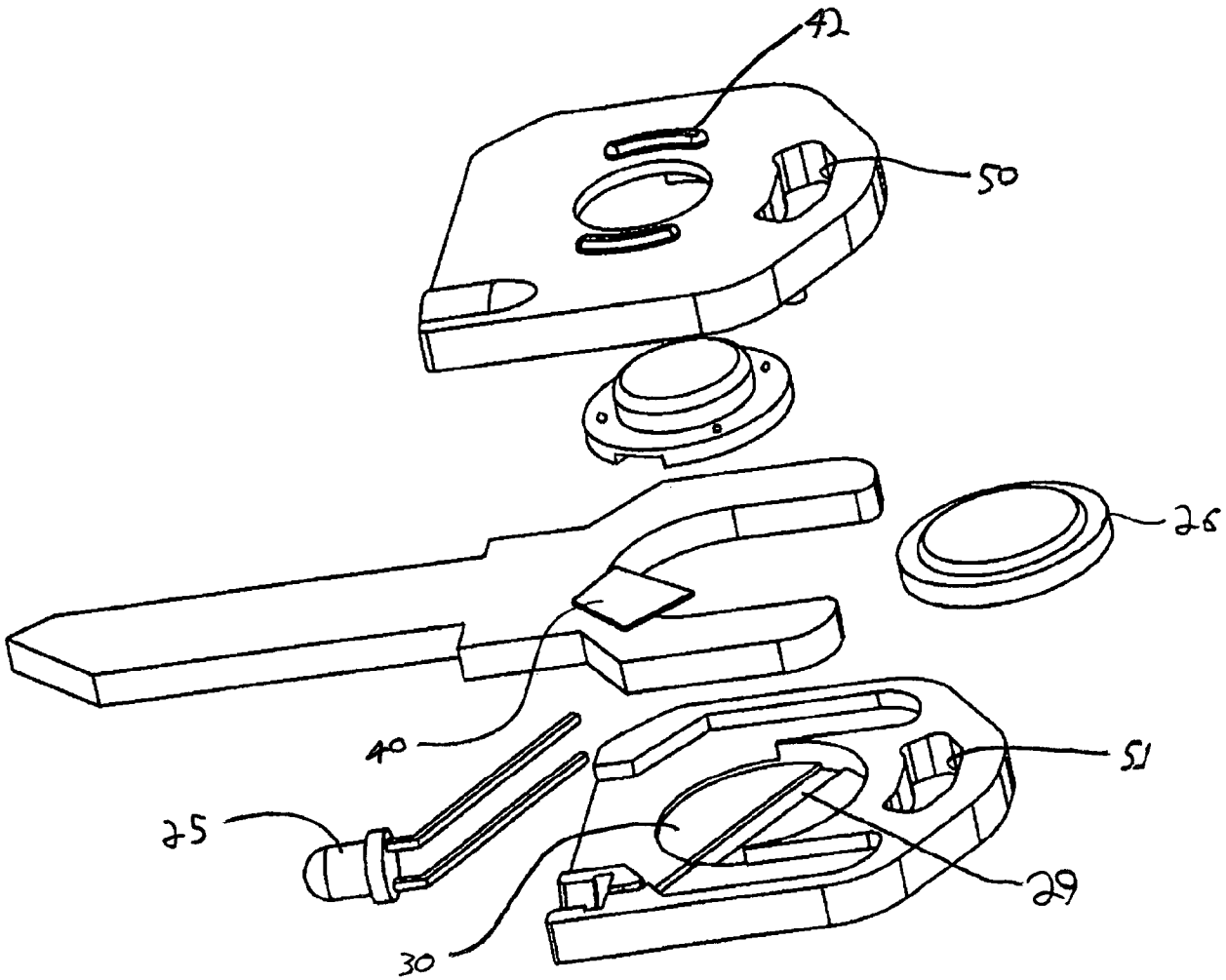
FIG. 7 is an exploded perspective view of a preferred key blank in accordance with the invention.

The casing 12 is sealed, preferably permanently, around head 18 and includes an upper housing 21 and a lower housing 22. A resilient button 23 protrudes through or is flush with the top surface of upper housing 21. As shown in FIG. 7, the preferred embodiment includes at least one button guard 42 to prevent the button from being depressed inadvertently while in the user's pocket or the like. Two crescent-shaped button guards 42 are shown in FIG. 7, however there is no limitation on the size, shape, or number of such buttons guards. A light source 25, preferably an LED, is enclosed by upper housing 21 and lower housing 22; for this purpose, upper housing 21 includes recess 27 and lower housing 22 includes mating recess 28, both are adapted to retain light source 25 in place so that it can shine light in the direction of blade 16. Light source 25 preferably has at least two leads 34 and 35 which are connectable to battery 26. As shown in FIG. 3, lower housing 22 includes channel 29 which is adapted to receive lower lead 34. Upper housing 21 has a channel 49 (see FIG. 6B) which is adapted to receive upper lead 35.

In one embodiment, as shown in FIGS. 1–3, upper housing 21 includes a ring hole 50 surrounded at least partially by stepped down portion 52. In another embodiment (see FIG. 6), ring hole 50 is not associated with a stepped down portion. In both embodiments, lower housing 22 has a corresponding ring hole 51. Ring holes 50, 51 allow key blank 10 to be attached to a key ring or keychain. The stepped down portion can facilitate the attachment of the key onto a key ring, however by thinning the plastic of the casing, the casing is weakened.

The upper and lower housings have further structures adapted to secure and retain the various other elements of the invention. Lower housing 22 has a substantially round recess 30 adapted to receive lower lead 34 and a battery 26. Of course, the recess 30 is round because the majority of batteries are flat round disks. The recess could be any shape to accommodate a battery of any shape. Lower housing 22 also has a U-shaped recess 31 adapted to receive substantially U-shaped head 18. Similarly, upper housing 21 has a substantially round recess 43 with a centrally disposed hole 37 adapted to receive actuator button 23. Again, the shape of the button and its corresponding recess is neither relevant to nor delimiting of the scope of the invention.

Lower lead 34 and upper lead 35 are adapted to fit over opposite sides of head 18 and battery 26. A non-conductive pad of material 40 is adapted to maintain space between head 18 and upper lead 35.

Figure 5A:
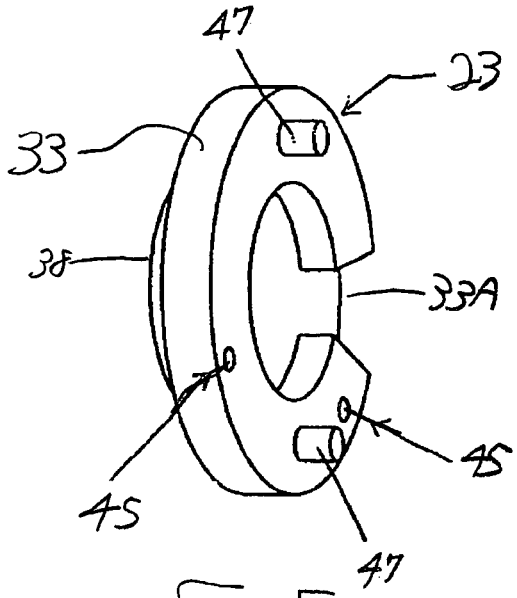
FIG. 5A is a bottom perspective view of a preferred actuator button in accordance with the invention.
Figure 5B:
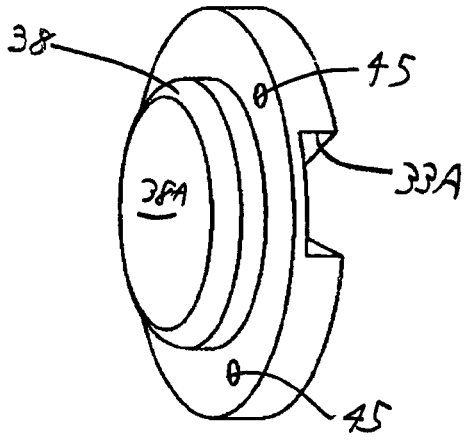
FIG. 5B is a top perspective view of the preferred actuator button of FIG. 5A.
Figure 5C:
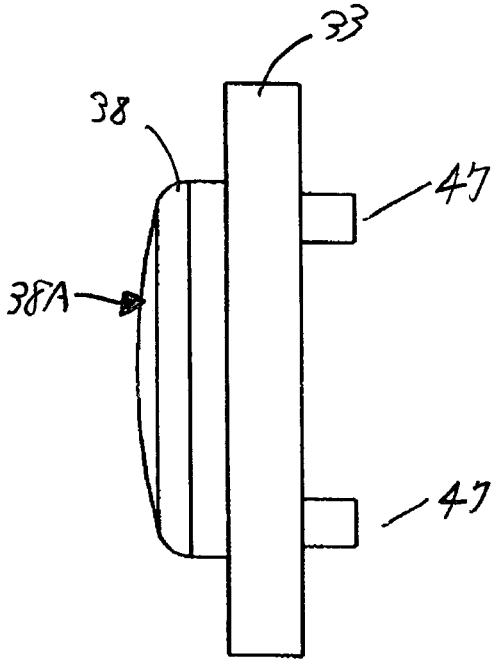
FIG. 5C is a side elevational view of the preferred actuator button of FIG. 5A.
Figure 6A:
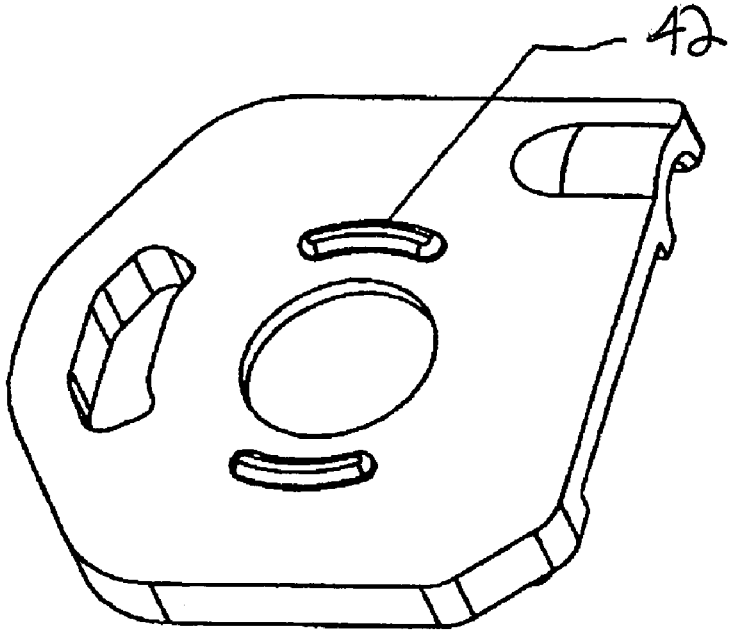
FIG. 6A is a top perspective view of a preferred upper housing in accordance with the invention.
Figure 6B:
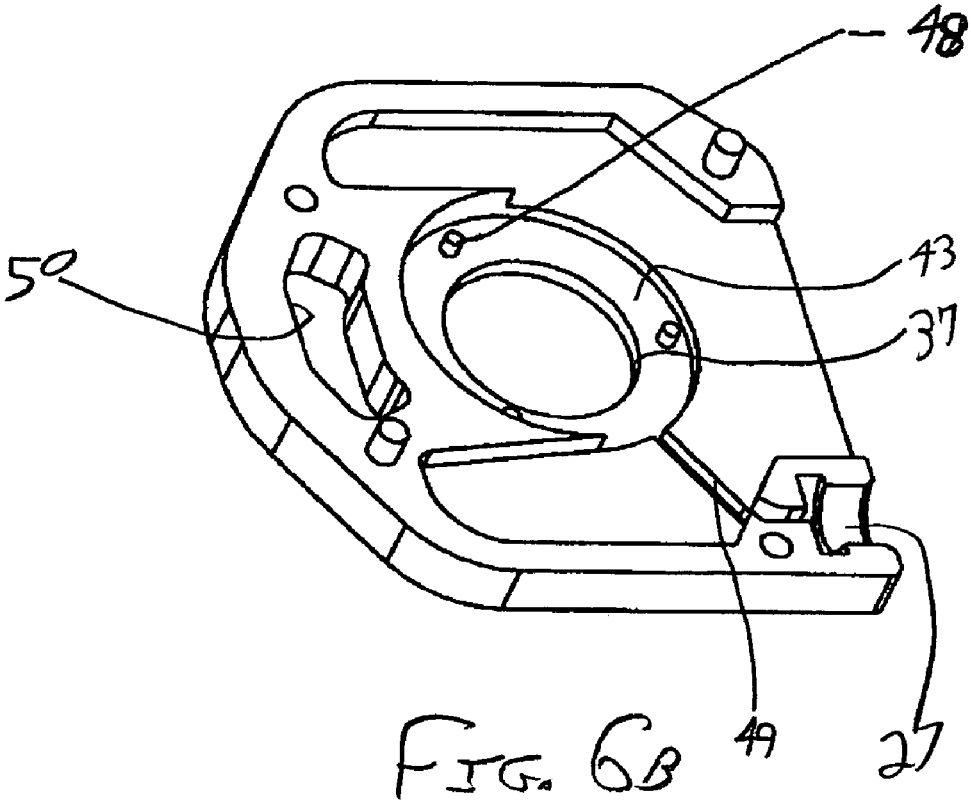
FIG. 6B is a bottom perspective view of the preferred upper housing of FIG. 6A.

As best shown in FIGS. 5A–C, button 23 has two main sections, a lower base portion 33 and a smaller upper portion 38. Lower base portion 33 fits within recess 30 of lower housing 22 and annular recess 43 of upper housing 21. Upper portion 38 fits within hole 37 so that upper surface 38A is accessible to a user. Upper portion 38 may protrude through hole 37 or it may be flush with the top surface of upper housing 21. Lower base portion 33 has a channel 33A which accommodates lower lead 34 and allows it to contact battery 26. Because of the resiliency of upper lead 35 and the thickness of head 18, and because non-conductive pad 40 is disposed between upper lead 35 and blank 16, space is maintained between upper lead 35 and battery 26, and the two elements are not in electrical contact when the device is in its natural inactive state.

It is important to insure that button 23 neither falls out of casing 12 nor rotates within casing 12 so that channel 33A is properly aligned with lower lead 34. To this end, the preferred embodiment of button 23 shown in FIGS. 5A–C includes retaining holes 45, which are adapted to receive posts 48 protruding from the underside of upper housing 21 (see FIG. 6B). Of course, posts 48 could be disposed on either housing and/or on button 23. Button 23 is also preferably provided with posts 47 on the underside of lower base portion 33 to increase the resiliency and maximum compressibility of button 23. When the device is assembled, posts 47 press into the top surface of battery 26.

Figure 4:
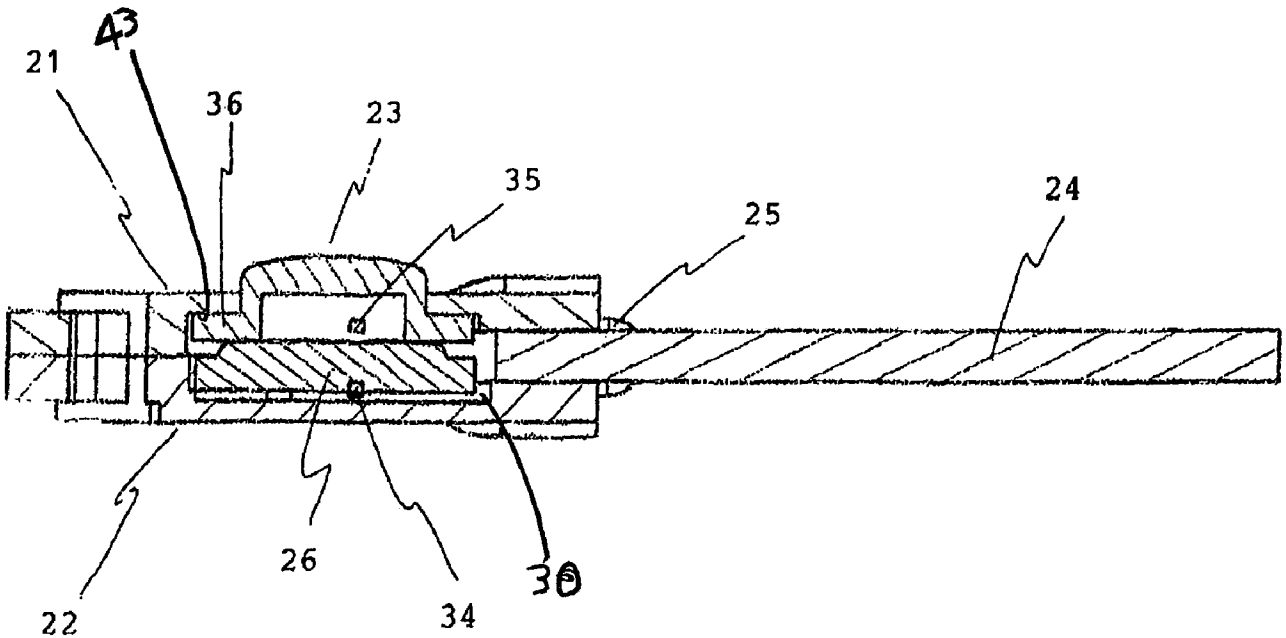
FIG. 4 is a sectional view of the key blank of FIG. 1 taken along line IV—IV of FIG. 2.

FIG. 4 shows a cross section view through the center of the key blank. Note that the annular recess 43 of upper housing 21 contacts lower base portion 33 of button 23. In turn, lower portion 33 of button 23 contacts battery 26. The underside of battery 26 thus maintains contact with lower lead 34. In a non-activated state (i.e., with the button not being depressed), the upper lead 35 is not in contact with upper surface of battery 26.

In operation, the inventive key blank works as follows: First, the key blank must be transformed into a key capable of operating a lock. This is generally accomplished at a locksmith shop or through a key making apparatus in a known fashion. A specific key can be identified by the color of casing 12 and/or by the color of the corresponding light. The color of the casing by itself serves to identify each key, but only under conditions where ambient lighting is sufficient for the human to identify basic colors. Under extremely dark conditions, the human eye cannot discern one color from another. However, by providing keys with matching casings and lights (e.g., a red light with a red casing, a blue light with a blue casing), or in the alternative, in a contrasting color (e.g., a yellow light with a black casing), the user can easily determine which key is which—as well as find the keyhole of a lock—even in utter darkness.

To activate the light source, the user presses the to top of button 23. As pressure is applied, button 23 deforms and pushes upper lead 35 into contact with the upper surface of battery 26, thus completing a circuit and lighting the light. To deactivate the light source, the user releases button 23 and the button returns to its original configuration, thereby allowing upper lead 35 to disengage from battery 23.

The casing is preferably made from plastic, and the two housings are preferably injection molded. The two housings are preferably sonic-welded together, or they may be joined via glue or adhesive. The important aspect of the attachment of the casing around the head of the key blank is that it be sealed around the head so that moisture and dirt cannot get inside the casing and damage the components. The key blank is preferably made from metal.

The invention is not limited to the above description. For example, although the drawings show an LED having two leads, any light source may be used, and the leads may take the form of wire, integrated circuits, etc. Further, although the casing is sealed, a battery door may be provided (e.g., on the bottom surface of the lower housing) so as to enable the replacement of the battery. Also, while the battery is preferably disposed in cutout 17 of head 18, the battery may be disposed elsewhere inside casing 12. Further, although it is preferred that head 18 have cutout 17 to receive battery 26 (and portions of button 23), it is not required to provide a cutout in head 18. Rather, the battery and button can sit atop or next to the head of a conventional solid key blank with no cutout. Similarly, the preferred embodiment for the actuator is a resilient button as described above. However, any type of actuator may be employed. Some examples of other actuators include: a rigid, spring-biased button; a flat conductive pad or pads connected to a circuit, whereby the user putting his finger on the pad completes the circuit; etc. The invention is not limited to these actuators.

Having described the invention with reference to the drawings, it should be understood that the scope of the invention is not limited by the drawings but rather is defined by the claims appearing hereinbelow. Variations and modifications to the above description that would be obvious to one skilled in the art are contemplated as within the scope of the invention.

What is claimed is:

1. An illuminated key blank, comprising:

a main body having a blade and a head integral with said blade as a single piece;

a cutout formed in said head, said head being substantially U-shaped;

a battery disposed in said cutout between the arms of the U;

a light source selectively electrically connectable to said battery via a selectively connectable lead; and a casing sealed around said head and said battery, wherein said casing holds said light source in place so as to shine light substantially in the direction of said blade.

2. An illuminated key blank according to claim 1, wherein said casing is permanently scaled around said head.

3. An illuminated key blank according to claim 1, wherein said main body comprises a conventional pre-made blank key with said cutout formed via one of cutting or punching.

4. An illuminated key blank according to claim 1, wherein said casing is made from colored plastic.

5. An illuminated key blank according to claim 4, wherein said light source shines light that is substantially the same color as said casing.

6. An illuminated key blank according to claim 4, wherein said light source shines light that is of a contrasting color as the color of said casing.

7. An illuminated key blank according to claim 1, wherein said light source comprises an LED having leads.

8. An illuminated key blank according to claim 1, wherein said casing substantially conforms to the profile of said head.

9. An illuminated key blank according to claim 8, wherein said casing does not substantially increase the overall profile of said head.

10. An illuminated key blank according to claim 1, said casing comprising an upper housing and a lower housing matingly secured together around said head.

11. An illuminated key blank according to claim 10, at least one of said upper and lower housings further comprising a recess shaped to receive said head.

12. An illuminated key blank according to claim 10, said upper and lower housings each having a substantially U-shaped recess to receive said head.

13. An illuminated key blank according to claim 10, further comprising:

a first substantially U-shaped recess formed in said upper housing adapted to receive said head;

a second recess formed in said upper housing within said first substantially U-shaped recess;

a hole formed in said upper housing within said second recess;

a third substantially U-shaped recess formed in said lower housing adapted to receive said head; and a fourth recess formed in said lower housing within said third substantially U-shaped recess adapted to receive said battery, wherein said first and third substantially U-shaped recesses matingly correspond when said upper and lower housings are sealed together.

14. An illuminated key blank according to claim 13, further comprising an actuator disposed in said second recess and accessible from outside said casing via said hole.

15. An illuminated key blank according to claim 10, each of said upper and lower housings further comprising a recess shaped to receive and retain said light source.

16. An illuminated key blank according to claim 10, further comprising:

a first recess formed in said upper housing shaped to receive and retain said light source;

a second recess formed in said lower housing shaped to receive and retain said light source, wherein said first and second recesses matingly correspond when said upper and lower housings are sealed together.

17. An illuminated key blank according to claim 16, said light source having a second lead in contact with said battery, said illuminated key blank further comprising:

a first channel formed in said upper housing adapted to receive one of said leads of said light source; and a second channel formed in said lower housing adapted to receive the other of said leads of said light source.

18. An illuminated key blank according to claim 10, further comprising:

a hole formed in said upper housing; and an actuator accessible by a user through said hole, wherein when said user activates said actuator, said selectively connectable lead is electrically connected to said battery and said light source is activated.

19. An illuminated key blank according to claim 18, further comprising raised protrusions disposed on an exterior of said upper housing substantially adjacent said hole for preventing inadvertent activation of said actuator.

20. An illuminated key blank according to claim 18, at least one of said actuator and said casing comprising retaining holes and at least the other of said actuator and said casing comprising retaining pins matingly engageable with said retaining holes.

21. A set of readily identifiable illuminated keys, comprising:

a first key blank including:

a first main body having a first lade and a first head integral with said first blade as a single piece;

a first cutout formed in said first head making said first head substantially U-shaped;

a first battery disposed in said first cutout between the arms of the first U;

a first light source, selectively electrically connectable to said first battery via a first selectively connectable lead; and a first casing of a first color sealed around said first head and said first battery, wherein said first casing holds said first light source in place so as to shine light substantially in the direction of said first blade;

and a second key blank including:

a second main body having a second blade and a second head integral with said second blade as a single piece;

a second cutout formed in said second head making said second head substantially U-shaped;

a second battery disposed in said second cutout between the arms of the first U;

a second light source, selectively electrically connectable to said second battery via a second selectively connectable lead; and a second casing of a second color different from said first color sealed around said second head and said second battery, wherein said second casing holds said second light source in place so as to shine light substantially in the direction of said second blade.

22. A set of keys according to claim 21, wherein at least one of said first and second light sources shines light that is substantially the same color as its respective casing.

23. A set of keys according to claim 21, wherein at least one of said first and second light-sources shines light that is of a contrasting color as the color of its respective casing.

24. An illuminated key blank, comprising:

a main body having a blade and a head integral with said blade, said head being substantially U-shaped;

a casing sealed around said head;

a battery disposed in said casing between the arms of the U of said head; and a light source disposed at least partially in said casing selectively electrically connectable to said battery; and wherein said casing holds said light source in place so as to shine light substantially in the direction of said blade.

* * * * *